US005325782A

United States Patent [19]

Strauss et al.

[11] Patent Number: 5,325,782

[45] Date of Patent: Jul. 5, 1994

[54] INSENSITIVE GUN PROPELLANT

[75] Inventors: Bernard Strauss, Rockaway; Sam M. Moy, Parsippany, both of N.J.

[73] Assignee: The United States of America as represented by the Secretary of the Army, Washington, D.C.

[21] Appl. No.: 93,914

[22] Filed: Jul. 20, 1993

[51] Int. Cl.[5] ..... C06B 45/12

[52] U.S. Cl. ..... 102/285; 102/290; 102/292; 149/19.1; 149/19.4; 149/17.71

[58] Field of Search ..... 102/285, 290, 292; 149/19.9, 19.91, 19.4

[56] References Cited

U.S. PATENT DOCUMENTS 5,034,072 7/1991 Becuwe ..... 149/19.4

5,067,995 11/1991 Nutt ..... 149/2

5,189,249 2/1993 Burkhardt et al. ..... 102/430

*Primary Examiner*—Peter A. Nelson

*Attorney, Agent, or Firm*—Anthony T. Lane; Edward Goldberg; Michael C. Sachs

[57] ABSTRACT

A gun propellant having reduced sensitivity to impact and improved burning rate, comprising crystallized NNHT particles admixed with a binder and at least one plasticizer. In a preferred embodiment, the binder is a nitrocellulose binder and the plasticizer is a liquid nitramine plasticizer. A preferred liquid nitramine plasticizer is selected from the group of ethyl nitrato ethyl nitramine and methyl nitrato ethyl nitramine. The propellant of this invention may be used or alone or may also include a quantity of RDX propellant. The propellant is suitable to be formulated for an artillery application or for a tank system.

7 Claims, No Drawings

INSENSITIVE GUN PROPELLANT

The invention described herein may be made, used, or licensed by or for the Government for Governmental purposes without the payment to me of any royalties thereon or therefor.

FIELD OF THE INVENTION

The present invention relates to gun propellants designed for both artillery and tank guns. More particularly, the present invention relates to gun propellants with comparable, if not better, energy than existing propellant candidates for those weapon systems while also having insensitivity to shaped charge jet attack.

BACKGROUND OF THE INVENTION

There is continued interest in the defense industries to prepare new materials with high energy properties. It is of interest that the new materials would be similar to RDX, but much more insensitive from a safety standpoint to shaped charge jet attack. As a result, a considerable amount of work has been done over this last decade to develop new insensitive munitions or insensitive high explosives using new ingredients.

Both nitroguanidine and RDX have seen wide use as ingredients for gun, rocket and explosive formulations. Each material has advantages and disadvantages which tend to direct the end use application for each. RDX is extensively used because of its energy and low cost, but, it is more sensitive to shaped charge jet attack. Nitroguanidine, which also has the potential for low cost production, is a relatively insensitive material, but suffers from a comparatively low energy content.

Neither system meets all the goals and objectives of modern systems. No amount of formulation effort can really change the inherent nature of RDX or nitroguanidine. For that reason, the prior art does not contain an appropriate propellant which is safe and effective in use, particularly for artillery and tank gun uses.

It is therefore an object of this invention to provide a gun propellant suitable for both artillery and tank guns.

Another object of this invention is to provide a propellant system with increased energy and with insensitivity to shaped charge jet attack.

Yet another object of this invention is to provide improved impetus values and increased energy while keeping temperatures below tank and artillery application thresholds.

Other objects will appear hereinafter.

SUMMARY OF THE INVENTION

It has now been discovered that the above and other objects of the present invention may be accomplished in the following manner. Specifically, a new propellant has been discovered which provides high energy and superior safety.

The propellant of the present invention incorporates a new cyclic nitramine, 2-nitroimino-5-nitro-hexahydro-1.3.5-triazine, hereinafter referred to as NNHT. NNHT has been discovered to have both improved munitions and high explosives insensitivity. NNHT also has high energy density and low sensitivity, and it has been discovered that it is an excellent candidate for application in gun propellant formulations. Because of the simplicity of the processing method to produce NNHT, the manufacturing cost will be low and the environmental impact, resulting from the process waste streams, is considered to be of a nature which can be made environmentally acceptable.

The structure of NNHT is a hybrid of RDX and nitroguanidine and possesses some properties that are intrinsic to both RDX and nitroguanidine. What has surprisingly been discovered, however, is that NNHT has a combination of both high energy and low sensitivity. NNHT has a higher density then nitroguanidine (1.75 g/ml vs. 1.71 g/ml) and is less sensitive to impact than RDX (89 cm Vs 22 cm). While there are similarities in the chemical nature of the prior art products, it has been discovered herein that the compound of the present invention, NNHT, has all of the advantages of both prior art compounds with none of the disadvantages. This new family of gun propellants exhibits outstanding burning rate characteristics. In addition, they also have relatively low flame temperatures.

DETAILED DESCRIPTION OF THE PREFERRED EMBODIMENT

As stated above, the propellant of this invention incorporates 2-nitroimino-5-nitro-hexahydro-1.3.5-triazine, herein known as NNHT. NNHT is admixed in a matrix to form a propellant system. The preferred matrix systems comprise a nitrocellulose binder in combination with either the liquid nitramine plasticizers, ethyl nitrato ethyl amine and methyl ethyl nitrato ethyl amine, the mixed nitrate ester plasticizers, trimethylolethane trinitrate, and triethylene glycol dinitrate, and the Bis 2,2-dinitro propyl acetyl/bis 2,2-dinitro propyl formal (50:50 mixture) plasticizer. Other plasticizers either in combination with nitrocellulose or other energetic binders may be used.

Fresh experimental lots were prepared with 35 micron NNHT, 9.6 micron and a 5.4 micron NNHT recrystallized in a pilot plant operation. NNHT was incorporated as the lone filler or in combination with RDX to further boost energy, especially for tank guns.

The objective of this invention was to develop new insensitive gun propellants which are superior to the baseline M30A1 triple-base propellant for artillery weapon systems and to the higher energy baselines JA2 and M43 for tank weapon systems. In order to demonstrate the effectiveness of the present invention, certain formulations and evaluations were conducted.

Table 1 and 2 summarize some of the new insensitive gun propellant candidates incorporating NNHT as its key ingredient as part of this invention.

TABLE I

PROPELLANT COMPOSITIONS FOR ARTILLERY USE

| component | 1 | 2 | 3 | 4 | 5 | 6 | 7 |
|---|---|---|---|---|---|---|---|
| NNHT (35 mm) | 48 | 10 | 20 | 30 | — | — | — |
| NNHT (9 mm) | — | — | — | — | 20 | 30 | — |
| NNHT (5 mm) | — | — | — | — | — | — | 20 |
| NC[1] (13.5% N) | 35 | 71 | 61 | 51 | 61 | 51 | 61 |
| Methyl NENA[2] | 8 | 9 | 9 | 9 | 9 | 9 | 9 |
| Ethyl NENA[2] | 8 | 9 | 9 | 9 | 9 | 9 | 9 |
| EC[3] | 1 | 1 | 1 | 1 | 1 | 1 | 1 |
| Impetus (J/g) | 1137 | 1108 | 1117 | 1125 | 1117 | 1125 | 1117 |
| Flame (°K.) | 2297 | 3106 | 3073 | 3042 | 3073 | 3042 | 3073 |

[1]nitrocellulose;
[2]Nitrato ethyl nitramine;
[3]ethyl centralite.

TABLE II

| PROPELLANT COMPOSITIONS FOR ARTILLERY USE | | | | |
|---|---|---|---|---|
| component | 8 | 9 | 10 | 11 |
| NNHT | 15.0 | 27.5 | 40 | 40 |
| NC[1] | 59.0 | 46.5 | 34 | 39 |
| TMETN[4] | 12.5 | 12.5 | 12.5 | — |
| TEGDN[5] | 12.5 | 12.5 | 12.5 | — |
| BDNPA/F[6] | — | — | — | 20 |
| EC[3] | 1 | 1 | 1 | 1 |
| Impetus (J/g) | 1101 | 1113 | 1125 | 1089 |
| Flame (°K.) | 3051 | 3013 | 2979 | 2899 |

[1]nitrocellulose;
[3]ethyl centralite;
[4]trimethlyolethane;
[5]triethylene glycol dinitrate;
[6]Bis 2,2 - dinitro propyl acetal/bis 2,2 - dinitro propyl formal (50:50 mixture).

TABLE III

| PROPELLANT COMPOSITIONS FOR TANK APPLICATION | | | | | | |
|---|---|---|---|---|---|---|
| component | 12 | 13 | 14 | 15 | 16 | 17 |
| RDX | 10 | 30.5 | 30.5 | 33 | 23 | 23 |
| NNHT (35μ) | 48.2 | 30.5 | — | 15 | — | — |
| NNHT (9μ) | — | — | 30.5 | — | 10 | — |
| NNHT (5μ) | — | — | — | — | — | 10 |
| NC[1] (13.5% N) | 28 | 23 | 23 | 34 | 50 | 50 |
| Methyl NENA[2] | 6 | 7.5 | 7.5 | 8.5 | 8 | 8 |
| Ethyl NENA[2] | 7 | 7.5 | 7.5 | 8.5 | 8 | 8 |
| EC[3] | 0.8 | 1 | 1 | 1 | 1 | 1 |
| Impetus (J/g) | 1171 | 1232 | 1232 | 1228 | 1186 | 1186 |
| Flame (°K.) | 3130 | 3324 | 3324 | 3382 | 3317 | 3317 |

[1]nitrocellulose;
[2]Nitrato ethyl nitramine;
[3]ethyl centralite.

TABLE IV

| PROPELLANT COMPOSITIONS FOR TANK APPLICATION | | |
|---|---|---|
| component | 18 | 19 |
| RDX | 20.0 | 35 |
| NNHT | 20.0 | 10 |
| NC[1] | 39.0 | 44 |
| TMETN[4] | 13.33 | — |
| TEGDN[5] | 6.67 | — |
| BDNPA/F[6] | — | 10 |
| EC[3] | 1 | 1 |
| Impetus (J/g) | 1181 | 1193 |
| Flame (°K.) | 3287 | 3397 |

[1]nitrocellulose;
[3]ethyl centralite;
[4]trimethlyolethane;
[5]triethylene glycol dinitrate;
[6]Bis 2,2 - dinitro propyl acetal/bis 2,2 - dinitro propyl formal (50:50 mixture).

The new insensitive gun propellants formulated for artillery usage described in TABLE I and TABLE II have impetus values shown in TABLE V ranging from 1108 J/g to 1171 J/g compared to 1085 J/g for the baseline M30A1. This represents a marked improvement of 2% to 8% respectively. Flame temperatures for the new candidate gun propellants are comparable to the M30A1.

TABLE V

| ARTILLERY PROPELLANT BURNING RATE DATA | | | | | | | |
|---|---|---|---|---|---|---|---|
| Experiment | M30A1 | 2 | 3 | 4 | 5 | 6 | 7 |
| Pressure Range (15–40k psi) | 2.676 | 0.623 | 1.277 | 2.111 | 1.182 | 1.644 | 0.969 |
| BR Coef. (×1000) | | | | | | | |
| Pressure Exponent | 0.74 | 0.87 | 0.83 | 0.77 | 0.81 | 0.80 | 0.82 |

TABLE V-continued

| ARTILLERY PROPELLANT BURNING RATE DATA | | | | | | | |
|---|---|---|---|---|---|---|---|
| Experiment | M30A1 | 2 | 3 | 4 | 5 | 6 | 7 |
| Impetus (J/g) | 1085 | 1108 | 1117 | 1125 | 1117 | 1125 | 1117 |
| Flame (°K.) | 3073 | 3106 | 3073 | 3042 | 3073 | 3042 | 3073 |

The new insensitive gun propellant formulations for tank systems TABLE III have impetus values ranging from 1171 J/g to 1232 J/g as compared to the baselines M43 (1181 J/g) and JA2 (1151 J/g) as shown in TABLE VI. This represents a significant improvement in energy. Flame temperatures for the new IM propellants are all below the threshold of 3440 of JA2 for tank applications.

TABLE VI

| TANK GUN PROPELLANT BURNING RATE DATA | | | | | | | |
|---|---|---|---|---|---|---|---|
| Experiment | M43 | JA2 | 12 | 13 | 14 | 15 | 16 |
| Impetus (J/g) | 1181 | 1151 | 1171 | 1232 | 1232 | 1228 | 1186 |
| Flame (°K.) | 3065 | 3439 | 3130 | 3324 | 3324 | 3382 | 3317 |
| Pressure Range (15–40 psi) | 0.734 | 1.152 | 5.046 | 2.822 | 3.764 | 1.487 | 0.673 |
| BR Coef. (×1000) | | | | | | | |
| Pressure Exponent | 0.86 | 0.86 | 0.68 | 0.77 | 0.73 | 0.82 | 0.87 |

Burning rate data as shown in TABLE V and TABLE VI indicate a major breakthrough. Pressure exponents were extremely low (comparable to M30A1 but far superior to M43 and JA 2). Concurrently, burning rate coefficients were higher than M43 and JA2, and comparable to M30A1. Low pressure exponents and high temperature coefficients are particularly important to the multi-zone unicharge application.

This new family of NNHT gun propellant is less sensitive to a shaped charge jet impact than a conventional candidate for one artillery application and a candidate for another weapon system. The NNHT gun propellants have better burning rate characteristics (low pressure exponent and high burning rate coefficient than prior art systems.

While particular embodiments of the present invention have been illustrated and described herein, it is not intended that these illustrations and descriptions limit the invention. Changes and modifications may be made herein without departing from the scope and spirit of the following claims.

We claim:

1. A gun propellant having reduced sensitivity to impact and improved burning rate, comprising crystallized NNHT particles admixed with a binder and at least one plasticizer.

2. The propellant of claim 1, wherein said binder is a nitrocellulose binder.

3. The propellant of claim 1, wherein said wherein said plasticizer is a liquid nitramine plasticizer.

4. The propellant of claim 3, wherein said liquid nitramine plasticizer is selected from the group of ethyl nitrato ethyl nitramine and methyl nitrato ethyl nitramine.

5. The propellant of claim 1, wherein said propellant is formulated for an artillery application.

6. The propellant of claim 1, wherein said propellant is formulated for a tank system.

7. The propellant of claim 1, wherein said propellant further includes a quantity of RDX propellant.

* * * * *